United States Patent [19]

Beelaard et al.

[11] Patent Number: 4,794,300

[45] Date of Patent: Dec. 27, 1988

[54] COLOUR PICTURE TUBE INCLUDING A DEFLECTION UNIT HAVING PICTURE BALANCE CORRECTION MEANS

[75] Inventors: Wilhelmus A. J. Beelaard; Albertus A. S. Sluyterman; Johannes A. P. De Volder, all of Eindhoven, Netherlands

[73] Assignee: U.S. Philips Corp., New York, N.Y.

[21] Appl. No.: 20,925

[22] Filed: Mar. 2, 1987

[30] Foreign Application Priority Data

Mar. 28, 1986 [NL] Netherlands ..... 8600810
Apr. 21, 1986 [NL] Netherlands ..... 8601003

[51] Int. Cl.[4] ..... H01J 29/72; H01F 1/00

[52] U.S. Cl. ..... 313/440; 335/211; 335/212

[58] Field of Search ..... 313/440, 426, 442; 358/248, 249; 335/212, 213, 211

[56] References Cited

U.S. PATENT DOCUMENTS 3,020,434 2/1962 Bloomsburgh ..... 313/440
4,145,677 3/1979 Maruyama et al. ..... 335/212
4,524,340 6/1985 Sluyterman ..... 335/212

*Primary Examiner*—David K. Moore
*Assistant Examiner*—K. Wieder
*Attorney, Agent, or Firm*—Thomas A. Briody; Leroy Eason

[57] ABSTRACT

A deflection unit for a color television picture tube having in the neck thereof an electron gun system for producing a central electron beam coplanar with two outer electron beams. The deflection unit comprises a system of line deflection coils and a system of field deflection coils. The gun end of the system of field deflection coils is provided with two plate-shaped elements of a soft-magnetic material located at a distance from each other in the circumferential direction of the neck of the tube. Such elements are movable in that direction from a neutral position in which the distances between the centers thereof and the outer beams are equal, to a position in which one of such distances is greater than the other in order to correct picture balance errors due to unequal deflection of the beams.

4 Claims, 3 Drawing Sheets

COLOUR PICTURE TUBE INCLUDING A DEFLECTION UNIT HAVING PICTURE BALANCE CORRECTION MEANS

BACKGROUND OF THE INVENTION

1. Field of the Invention

The invention relates to a device for displaying television pictures by means of a color picture tube whose neck accommodates an electron gun system for emitting to a dislay screen three electron beams, a central beam which coincides at least substantially with the axis of the picture tube and two outer beams located on either side thereof, such device including a deflection unit which is secured coaxially around the picture tube, which deflection unit comprises a system of line deflection coils which when energized deflects the electron beam in a first direction and a system of field deflection coils which when energized deflects the electron beam in a direction at right angles to the first direction, said system of field deflection coils comprising two field deflection coils located diametrically with respect to each other, each field deflection coil comprising a plurality of conductors extending in the longitudinal direction of the deflection unit.

2. Description of the Related Art

In color picture tubes of the in-line type the electron gun system is adapted to generate three coplanar electron beams which converge on the display screen. The deflection unit placed around the picture tube for deflecting the electron beams is used to deflect the electron beams in one or in the other direction of their normal non-deflected straight path so that the beams impinge upon selected dots of the display screen to provide visual indications thereon. By varying the magnetic deflection fields in a suitable manner, the electron beams can be moved upwards or downwards and to the left or to the right across the (vertically placed) display screen. By simultaneously varying the intensity of the beams a visual presentation of information or an image can be formed on the display screen. The deflection unit secured around the neck portion of the picture tube comprises two systems of deflection coils to enable the electron beams to be deflected in two directions at right angles with respect to each other. Each system comprises two coils placed on sides facing each other of the neck of the tube, the systems being displaced with respect to each other around the neck of the tube over an angle of 90°. Upon energizing the two systems of deflection coils produce orthogonal deflection fields.

The fields are essentially at right angles to the path of the non-deflected electron beams. A cylindrical core of a magnetizable material, which may tightly enclose the systems of deflection coils if they are both of the saddle-type, is generally used to concentrate the deflection fields and to increase the flux density in the deflection region.

Field deflection coils of the saddle-type are self-supporting coils comprising a plurality of conductors which are wound to form longitudinal first and second side packets, an arc-shaped first end segment and an arc-shaped second end segment together defining a window aperture. In such coils the rear end segments (on the side of the gun) may be flared with respect to the profile of the picture tube (the original type of saddle coil) or they may be arranged flat against the tube wall (in this type of saddle coil the rear end segment follows, as it were, the tube profile). Alternatively, the field deflection coils may be of the type which is toroidally wound on an annular core.

After mounting a deflection unit provided with field deflection coils and line deflection coils on the picture tube for which it is intended, a convergence error is often found to occur during operation, which error becomes manifest as an y-error at the ends of the picture axis. This error is referred to as a picture balance error when the raster written by the one outer beam is larger in the vertical direction than the raster written by the other outer beam. This error is referred to as picture twist error when the raster written by the one outer beam lies above (or below) the raster written by the other outer beam.

SUMMARY OF THE INVENTION

It is an object of the invention to provide means by which deflection errors at the ends of the picture axis, and more particularly picture balance errors, can be corrected.

According to the invention this object is realized in that a display device of the type described in the opening paragraph comprises a system of deflection coils which is provided at the beam entrance side of the deflection field generated thereby with two first plate-shaped elements of a soft magnetic material placed at a distance from each other in the circumferential direction of the neck of the tube, which elements are movable in the circumferential direction ofthe neck of the tube and each have a neutral position in which neutral positions the distance between the centre of each of the first elements and the outer beams is equally large, whilst the first elements are located parallel to the tube axis and are situated closer to the neck of the tube than the field deflection coils.

When the above-described soft-magnetic elements present in the vertical deflection field are displaced from their neutral position in opposite directions, i.e. one element clockwise and the other counterclockwise along the circumference, they will be located closer to the one outer beam than to the other and will render the vertical deflection field asymmetrical. This asymmetry of the vertical deflection field is utilised within the scope of the invention to correct picture balance errors.

Since the picture balance error may be different from display device to dislay device, the correction which is necessary may likewise differ. Adaptation of the correction is achieved by varying the distances between the correction elements and the one and the other outer beam. According to the invention the elements are to this end disposed so as to be movable in the circumferential direction of the neck of the tube. The elements may be movable, for example, over their own guide face having a radius of curvature which is equal to the distance between the guide face and the tube axis.

To ensure that the picture balance correction elements generate a field coma error which is as small as possible, the elements according to a further embodiment of the invention are each movable over their own guide face having a radius of curvature which is larger than the distance between the guide face and the tube axis.

A further embodiment of the display device according to the invention is characterized in that the system of field deflection coils is also provided with a pair of second plate-shaped elements of a soft-magnetic material arranged at right angles to the vertical deflection field in an axial position which is further remote from the beam entrance side of the deflection field generated by the field deflection coils than the position of the first plate-shaped elements. Such elements are used to correct coma. These elements may have a rectangular basic shape, but to increase the control range of the picture balance correction elements it is particularly advantageous to form each of them by means of a central portion extending in the circumferential direction of the neck of the tube and being provided at its extremities with limbs extending parallel to the tube axis.

The invention more particularly relates to a deflection unit for a device as described above.

BRIEF DESCRIPTION OF THE DRAWINGS

The invention will be described in greater detail with reference to the drawings, wherein.

DESCRIPTION OF THE PREFERRED EMBODIMENTS

Figure 1:
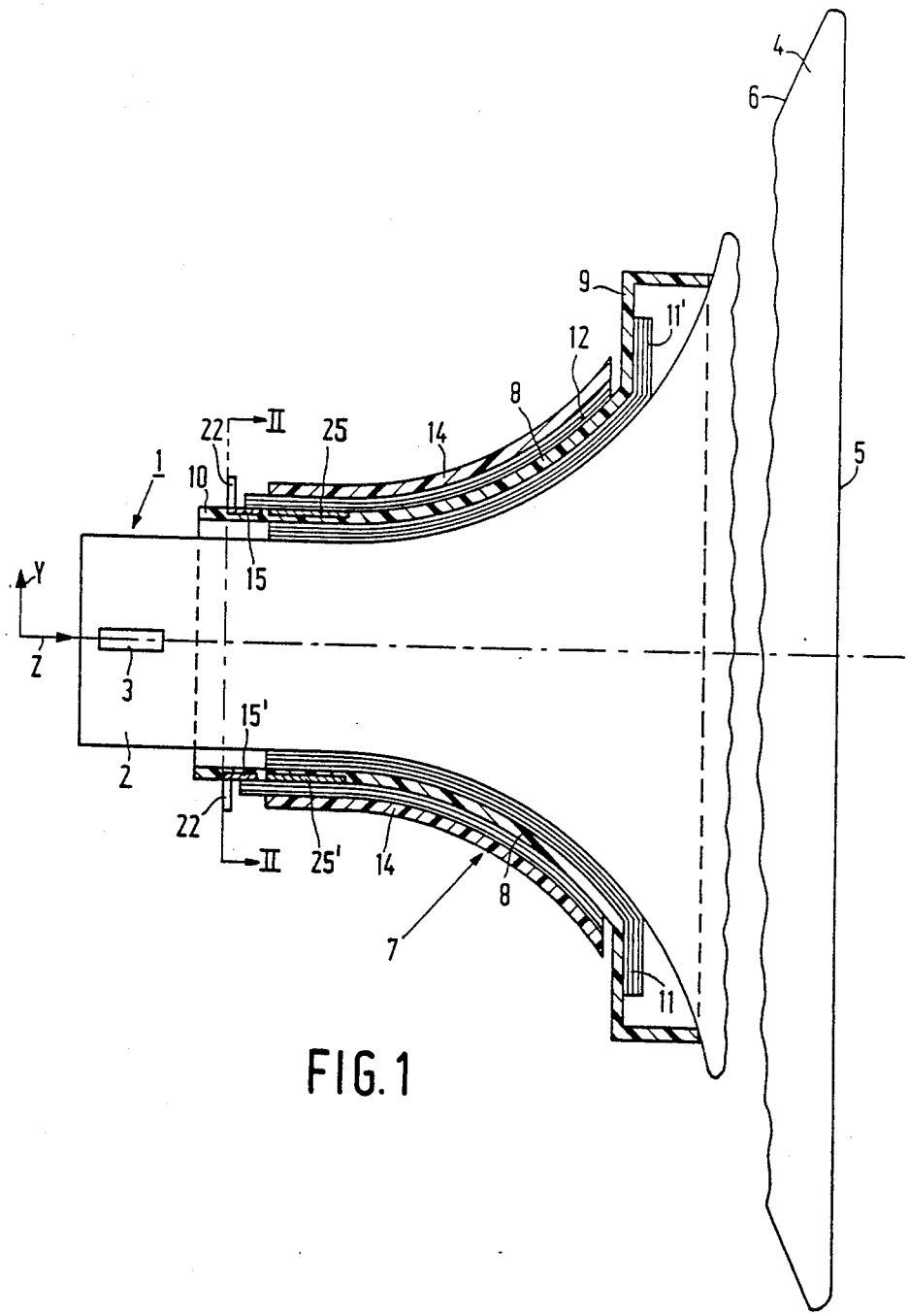
FIG. 1 diagrammatically shows a cross-section (taken on the y–z plane) of a display device comprising a cathode-ray tube and a deflection unit mounted thereon.

FIG. 1 shows in a cross-section a display device comprising a cathode-ray tube 1 with an envelope 6 extending from a narrow neck portion 2 in which an electron gun system 3 is mounted to a wide cup-shaped portion 4 which is provided with a display screen 5. A deflection unit 7 is mounted on the tube at the transition between the narrow and the wide portion. This deflection unit 7 has a support 8 of an insulating material with a front end 9 and a rear end 10. Between these ends 9 and 10 there are provided on the inside of the support 8 a system of deflection coils 11, 11' for generating a (horizontal) deflection field for the horizontal deflection of electron beams produced by the electron gun system 3, and a system of coils 12, 12' on the outside of the support 8 for generating a (vertical) deflection field for the vertical deflection of electron beams produced by the electron gun system 3. The systems of deflection coils 11, 11' and 12, 12' are surrounded by an annular core 14 of a magnetizable material. The separate coils 12, 12' of the system of field deflection coils as well as the coils 11, 11' of the system of line deflection coils are of the saddle-type with rear end segments arranged flat against the tube wall.

Figure 4:
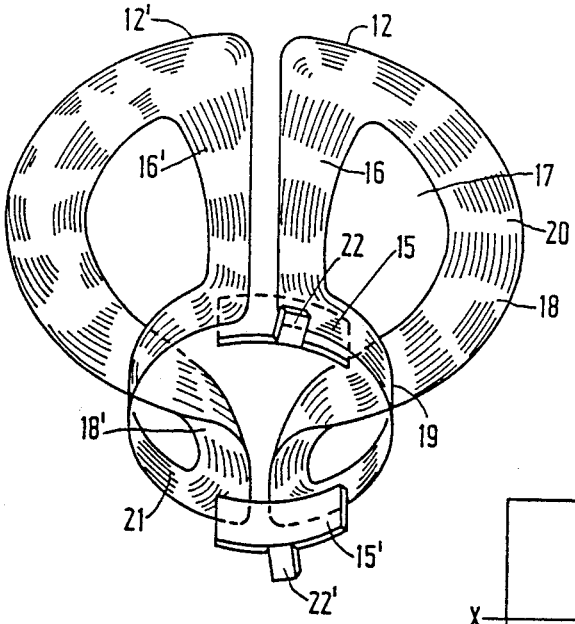
FIG. 4 is a perspective rear view of a system of field deflection coils according to the invention.

FIG. 4 is a perspective view of the system of field deflection coils 12, 12' of FIG. 1, viewed from the gun side. Coil 12 consists of a first side packet 16 and a second side packet 18, and a rear end segment 19 and a front end segment 20 together defining a window 17. Compared with the front end segments 20, the rear end segments 19 are arranged flat against the tube wall. Coil 12' is constructed in the same manner as coil 12. Coil 12' has a rear end segment 21 arranged flat against the tube wall. The system of field deflection coils 12, 12' has plate-shaped elements 15, 15' of a soft-magnetic material positioned parallel to and closer to the tube axis 2 than the field deflection coils 12, 12'. The elements 15, 15' are arranged in such a way that on the side with the narrower diameter they are located opposite to the packets of current conductors 16, 18 and 16', 18' of the coils 12, 12' on the inside thereof. This means that each of them faces a current- conductor packet of coil 12 and a current-conductor packet of coil 12'.

Figure 3A:
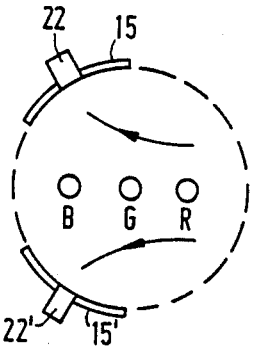
FIGS. 3*a*, 3*b* and 3*c* diagrammatically show elevational views of corresponding cross-sections.
Figure 3B:
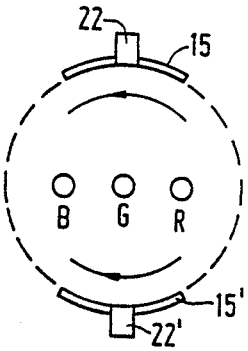
Figure 3C:
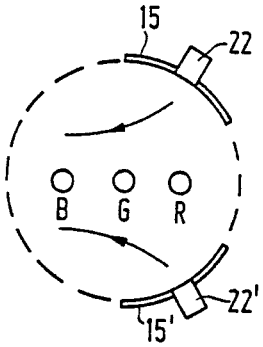
Figure 5:
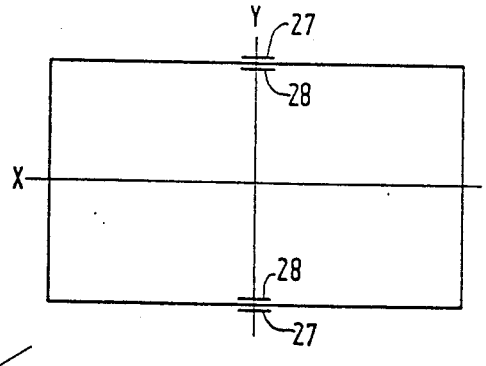
FIG. 5 shows a picture balance error with reference to rasters written on a display screen.

The elements 15, 15' are movable in the circumferential direction of the tube neck by using "grips" 22 and 22'. FIGS. 3*a*, 3*b* and 3*c* diagrammatically show what can be achieved by this. In the situation of FIG. 3*b* the elements 15, 15' are in their neutral position (central position). The vertical deflection field denoted by arrows is then symmetrical. When correcting picture balance errors the elements 15, 15' are moved in such a way that the distance between their center and the one outer beam becomes smaller (beam B in FIG. 3*a*; beam R in FIG. 3*c*) and larger with respect to the other outer beam. The vertical deflection field denoted by the arrows will then be asymmetrical. This asymmetry is the effect of the addition of a 90° Q-pole component to the vertical deflection field. The (symmetrical) change in the variation of the flux lines is the effect of the addition of a positive field sixpole component. Picture balance errors can be corrected by setting the positions of the elements 15, 15'. An example of a picture balance error to be corrected in accordance with the invention is shown in FIG. 5. The raster 27 (for example, the red raster) written by the one outer beam on the display screen and measured at the ends of the vertical axis is larger than the raster 28 (in this case the blue raster) written on the display screen by the other outer beam.

Figure 2:
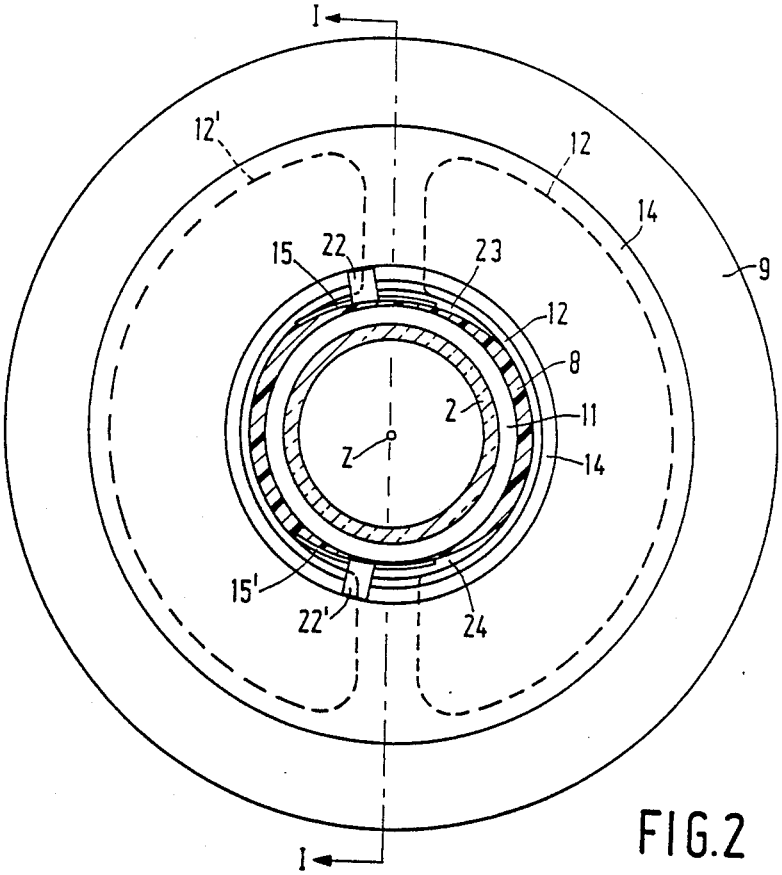
FIG. 2 is an elevational view of a cross-section taken on the line II—II' in FIG. 1.

Reverting to FIG. 2 it can clearly be seen that the picture balance correction elements 15, 15' are movable over guide faces 23, 24 which have a radius of curvature (for example, 29 mm) which is larger than their distance to the tube axis z (for example, 18.5 mm). This has been done to minimise the generation of field coma errors by the elements 15, 15'.

When used in a deflection unit for a picture tube with a 51-cm screen diagonal the elements made of, for example, an Si-Fe alloy had a length of 29 mm, a width of 10 mm and a thickness of 0.35 mm.

Movable picture balance correction elements 15, 15' can be provided in a particularly simple manner in the deflection unit of the type shown in FIG. 1. Since the line deflection coils 11, 11' of the deflection unit 7 shown extend less far in the direction of the gun system 3 than the field deflection coils 12, 12', the elements 15, 15' may be positioned behind the line deflection coils 11, 11'.

The field deflection coils 12, 12' shown in FIG. 1 are of the (saddle) type with rear end segments arranged flat against the tube wall.

The correction elements 15, 15' extend in this case preferably partly under and partly beside these flatly arranged end segments. See FIG. 4. The invention is, however, not limited to the use of field deflection coils of the saddle type with flatly arranged end segments. Alternatively the use of field deflection coils of the saddle type with flared end segments or of field deflection coils of the type toroidally wound on an annular core is possible. For toroidally wound field deflection coils, mostly in combination with a saddle-shaped line deflection coil, the correction elements are actually not positioned under the field deflection coil windings but behind them. Since the toroidal vertical field is long, the magnetic field can be influenced as required. For asymmetrical influence of the vertical deflection field by the correction elements this makes no difference.

Figure 6:
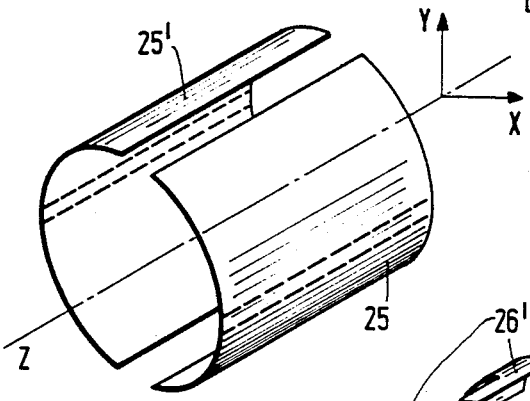
FIG. 6 shows a pair of coma correction elements 25, 25' which may be provided in the deflection unit of FIG. 1.

It is to be noted that the inventive picture balance correction elements are not to be confused with the coma correction elements and astigmatic correction elements (so-called field shapers) which have been known since 1978 and which consist of bent plates of a soft-magnetic material positioned between the system of field deflection coils and the system of line deflection coils. (see Philips Technical Review 39, pages 154–171, 1980, no. 6/7). The picture balance correction elements according to the invention may be readily used in combination with these other correction elements. For example, with coma correction elements 25, 25' as shown in FIGS. 1 and 6 which may be provided between the line deflection coils 11, 11' and the field deflection coils 12, 12' in recesses in the outer side of the support 9 in a position which is further remote from the beam entrance side of the deflection field generated by the field deflection coils 12, 12' than the position of the picture balance correction elements. In this case the corection elements 25, 25' are provided in such a way that element 25 is added to field deflection coil 12 and element 25' is added to field deflection coil 12'. FIG. 6 shows bent elements 25, 25' having a rectangular basic shape. A characteristic dimension in the z direction is, for example, 20 mm for use in a 110° picture tube with a display screen having a 26-inch diagonal. The elements 25, 25' may each consist of one piece. To minimise a possible influence on the line deflection field, they may alternatively consist of two parts as is shown by broken lines in FIG. 6.

Figure 7:
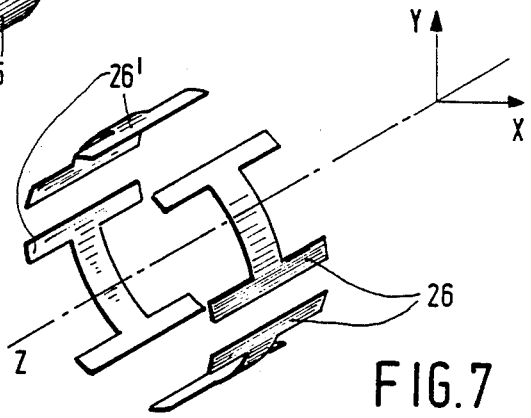
FIG. 7 shows a pair of coma correction elements 26, 26' having a modified form.

Instead of a rectangular basic shape as in FIG. 6 the coma correction elements may have a modified rectangular shape as in FIG. 7 which is suitable for obtaining a larger control range of the picture balance correction elements 15, 15'.

The elements 26, 26' shown in FIG. 7 have a shape suitable for this purpose. This shape is characterized by a central portion extending in the circumferential direction of the neck of the tube, whilst the extremities of this portion have limbs extending parallel to the tube axis z.

Correction elements of the type shown in FIG. 7 cannot only be used advantageously in combination with picture balance correction elements of the type shown in FIG. 4 (elements 15 and 15', but also in combination with two U-shaped correction elements each comprising on their outer side a longitudinal wire bundle (for example, the wire bundle 16') of the one field deflection coil and a longitudinal wire bundle (for example, the wire bundle 16) of the other field deflection coil. (See U.S. Pat. No. 4,524,340).

What is claimed is:

1. An improved deflection unit for a color television picture tube whose neck accommodates an electron gun system for emitting to a display screen three electron beams, a central beam which coincides at least substantially with the axis of the picture tube and first and second outer beams located on either side thereof; such deflection unit being secured coaxially around the picture tube and comprising a system of line deflection coils which when energized deflects the electron beam in a first direction and a system of field deflection coils which when energized deflects the electron beam in a direction at right angles to the first direction; said system of field deflection coils comprising two field deflection coils located diametrically with respect to each other, each field deflection coil comprising a plurality of conductors extending in the longitudinal direction of the deflection unit; such improvement being characterized in that at the beam entrance side of the deflection field generated by the field deflection coils and situated in such field there is provided a first pair of substantially rectangular plate-shaped elements of a soft-magnetic material which extend parallel to the tube axis and are at a distance from each other in the circumferential direction relative to the neck of the tube; each of such first pair of elements being movable in such circumferential direction from a neutral position in which the distances between the center of each such element and each of said first and second outer beams are equal, to a position in which the distance between the center of each such element and said first outer beam exceeds the distance to said second outer beam; said first pair of elements being situated closer to the neck of the tube than the field deflection coils; whereby said first pair of elements can be moved to positions in which they provide convergence correction of the deflection field generated by the field deflection coils.

2. A deflection unit as claimed in claim 1, characterized in that each of said first pair of elements is supported on and movable over a guide face member having a radius of curvature from the tube axis which is larger than the distance between such guide face member and the tube axis.

3. A deflection unit as claimed in claim 1, characterized in that a second pair of substantially rectangular plate-shaped elements of a soft-magnetic material is arranged at right angles to the deflection field generated by the field deflection coils and located at an axial position more remote from the beam entrance side of such deflection field than the axial position of the first pair of plate-shaped elements, said second pair of elements providing coma correction of such deflection field.

4. A deflection unit as claimed in claim 3, characterized in that each second plate-shaped element has a central portion extending in the circumferential direction of the neck of the tube and at its extremities has limbs extending parallel to the tube axis.

* * * * *